United States Patent [19]

Arff

[11] 3,951,027

[45] Apr. 20, 1976

[54] SAW CHAIN

[75] Inventor: Uwe F. Arff, Peterborough, Canada

[73] Assignee: Outboard Marine Corporation, Waukegan, Ill.

[22] Filed: May 9, 1974

[21] Appl. No.: 468,456

[52] U.S. Cl. ..... 83/834

[51] Int. Cl.[2] ..... B27B 33/14

[58] Field of Search ..... 30/381, 382, 383, 384, 30/385, 386; 83/833, 834, 830

[56] References Cited

UNITED STATES PATENTS

| | | | |
|---|---|---|---|
| 2,826,226 | 3/1958 | Donley | 30/383 |
| 2,923,329 | 2/1960 | Gudmundsen | 83/834 |
| 3,180,378 | 4/1965 | Carlton | 83/834 |

*Primary Examiner*—Al Lawrence Smith
*Assistant Examiner*—J. C. Peters
*Attorney, Agent, or Firm*—Michael, Best & Friedrich

[57] ABSTRACT

Disclosed herein is a saw chain including a center link having a trailing portion pivotally connected between the leading portions of an opposed pair of side links, one of which is a cutting link having a cutting tooth and a depth gauge. The center link includes an upwardly projecting tang which is located in laterally adjacent relation with the depth gauge and extends in the direction of the cutting tooth beyond a plane extending vertically from the axis of the pivotal connection between the trailing portion of the center link and the leading portions of the side links. During travel around the nose portion of the cutter bar, an outer corner of the tang projects outwardly beyond the uppermost edge of the depth gauge, i.e. overrides the depth gauge, and rides in the bottom of the saw kerf to limit the depth of cut made by the cutting tooth.

12 Claims, 4 Drawing Figures

SAW CHAIN

BACKGROUND OF THE INVENTION

This invention relates to chain saws and, more particularly, to saw chains therefor.

Conventional saw chains usually include a plurality of longitudinally spaced cutting links having a cutting tooth and a jointer or depth gauge positioned forwardly of the cutting tooth. The cutter links are connected together by center links and side links to form a continuous, articulated chain. The depth gauges are positioned to normally engage the bottom of the saw kerf so as to control the depth of cut made by the cutting teeth and to prevent undue digging of the cutting teeth into the material being cut. The saw chain is normally guided in a groove or track on the peripheral edge of a cutter bar. During travel about the outer end or nose of the cutter bar, the chain moves through an arcuate path having a relatively small radius.

When cutting is attempted with the nose portion of the cutter bar of such conventionally arranged saw chains the cutting teeth, during the initial portion of the travel around the cutter bar nose, have a tendency to attempt a cut deeper than they are capable of making. Because of the relative sharp turn the cutting links must make during this portion of traveling, the effective vertical distance between the leading depth gauge and the cutting edge of the trailing cutting tooth increases, permitting the attempted deeper penetration by the cutting tooth which can result in a kickback or upward movement of the chain saw toward the operator.

In addition, when the chain saw is used to cut timber having a relatively small diameter, such as brush or tree branches, the voids or spaces between the trailing portion of one cutting link and the leading portion of the depth gauge of the succeeding cutting link represents an area which can become locked or snagged with the branches being cut, causing a jerky operation of the chain saw and possibly even stalling of the chain saw motor or breaking of the chain.

It has been proposed to provide a saw chain with links having a guard portion which is shaped to either fill or partially fill the spaces between the cutter links so as to prevent branches from dropping into the spaces or to cam the branches out of the spaces. Examples of prior art saw chain arrangements including such a feature are disclosed in the following patents:

Robinson U.S. Pat. No. 3,329,183, issued July 4, 1967

Carlton U.S. Pat. No. 3,180,378, issued Apr. 27, 1965

Stihl U.S. Pat. No. 2,963,055, issued Dec. 6, 1960

Donley U.S. Pat. No. 2,826,226, issued Mar. 11, 1958

Carlton Canadian Pat. No. 652, 520, issued Nov. 20, 1962

Stihl Austrian Pat. No. 1,098,186, issued Jan. 26, 1961.

SUMMARY OF THE INVENTION

In accordance with the invention, the above problems are eliminated or minimized by employing a safety or center link pivotally mounted in laterally adjacent relation with the depth gauge of the succeeding cutting link and including an upper tang having an upper end portion which extends toward the cutting link and terminates in an outer corner located rearwardly of a transverse plane extending vertically from the common pivot axis of the safety or center link and the cutting link. When the saw chain travels around the nose portion of the cutter bar, the safety link pivots relative to the cutting link causing the outer corner of the upper tang to project outwardly beyond the uppermost edge of depth gauge and to ride in the bottom of the saw kerf to limit the depth of cut made by the trailing cutting tooth. The safety or center link also includes an upwardly inclined upper margin which minimizes the possibility of small limbs or branches becoming snagged or hooked on the leading portion of the depth gauge.

Also in accordance with the invention, the upper edge of the upper tang is generally co-planar with and in close proximity to the uppermost edge of the depth gauge of the succeeding cutting link during travel along the elongated flat parts of the cutter bar. This minimizes interference with chip flow and insures that the relative heights of the upper tang and the depth gauge are maintained constant during sharpening of the cutting link, thereby maintaining a constant degree of anti-kick protection over the full life of the saw chain.

A principal feature of the invention is the provision of a safety link for a saw chain which provides improved anti-kick protection during boring or cutter bar nose cutting operations.

Another feature of the invention is the provision of such a safety link which is capable of providing a constant degree of anti-kick protection over the full life of the saw chain.

A further feature of the invention is the provision of a safety link for a saw chain which is capable of stabilizing the saw chain during normal cutting operations.

Other features and advantages of the invention will become apparent upon reviewing the following detailed description, the drawing and the appended claims.

DESCRIPTION OF THE PREFERRED EMBODIMENTS

Figure 1:
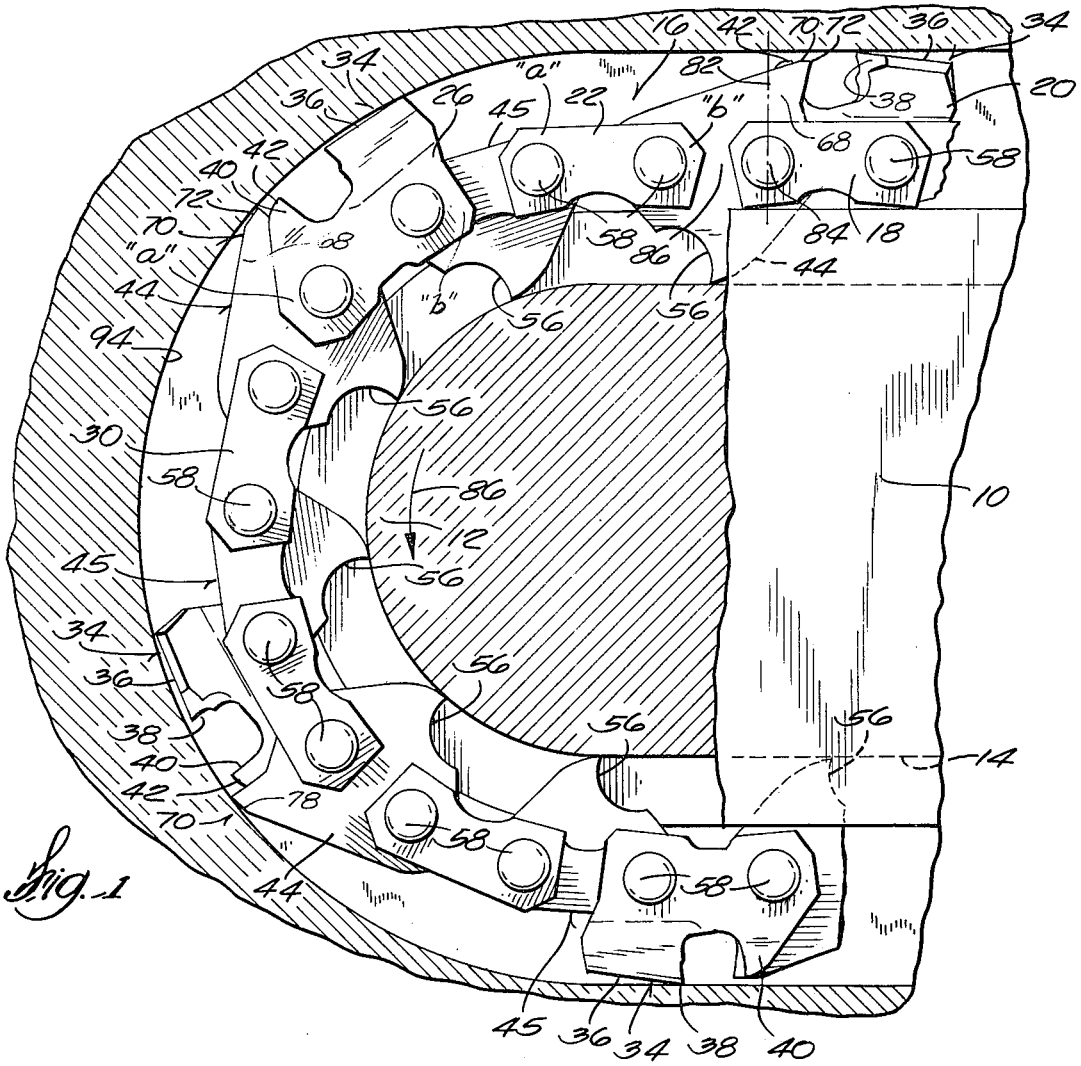
FIG. 1 is a fragmentary, side elevation view of a cutter bar of a chain saw and a saw chain embodying various of the features of the invention, shown with the nose portion of the cutter bar making a cut.

Before explaining the invention in detail, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

Fragmentarily illustrated in the drawing is a chain saw cutter bar 10 having a rounded nose 12 and a peripheral groove 14 in which a saw chain 16 is guided. The saw chain 16 includes a series of opposed, longitudinally-spaced pairs of right and lefthand side links 18, 20, 22, 24, 26, 28, 30 and 32, each having a forward or leading portion *a* and a rearward or trailing portion *b*. Every other of the link pairs alternately includes either a left or righthand cutting link designated generally by numeral 34. Projecting from the trailing portion *b* of each of the cutting links 34 is a cutting tooth 36. The leading edge of the cutting tooth 36 is beveled or otherwise shaped to form a transversely extending chisel or cutting edge 38. Projecting from the leading portion *a* of each of the cutting links 34 and spaced forwardly of the cutting tooth 36 is a jointer or depth gauge 40 having an uppermost edge 42 which is spaced at predetermined joint clearance below the cutting edge 38 of the cutting tooth 36.

Figure 3:
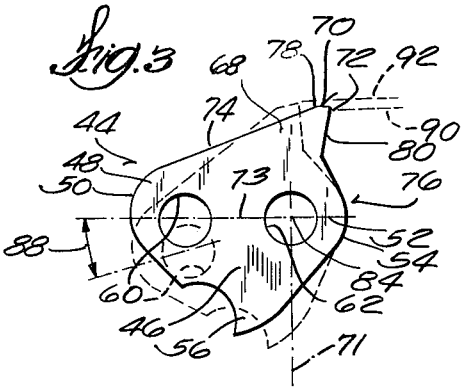
FIG. 3 is a side view of a center link incorporated in the saw chain shown in FIGS. 1 and 2.

Located between successive pairs of the side links are center links 44 and 45 which are disposed between the links of each pair. As best shown in FIG. 3, which illustrates the center link 44 only, the center links 44 and 45 include a main body 46 having a leading portion 48 with a leading edge 50, a trailing portion 52 with a trailing edge 54, and a downwardly projecting drive tang or lug 56 which is adapted for guided travel in the peripheral groove 14 of the cutter bar 10 and for engagement by a sprocket (not shown) to cause chain movement.

The center links and the side links are connected together in articulated relation by means, such as rivets 58, pivotally connecting the leading portion 48 of each center link with the trailing portion *b* of the proceeding pair of side links and pivotally connecting the trailing portion 52 of each center link with the leading portion *a* of the succeeding pair of side links. For making these pivotal connections, each center link 44 and 45 is provided with a pair of longitudinally spaced apertures 60 and 62 and each pair of side links are provided with a pair of longitudinally spaced apertures 64 and 66 which are located coaxially with respective center link apertures 60 and 62 when the chain 16 is assembled. The construction described thus far is generally conventional.

In accordance with the invention, the center links 44, i.e., those interposed adjacent pairs of side links and pivotally connected to the leading portions *a* of the pairs of side links including a cutting link 34, are provided with an upper tang 68 which is arranged to control the depth of cut made by the cutting tooth 36 during travel around the nose 12 of the cutter bar 10 and to stabilize the operation of the chain 16 during normal cutting operations. More specifically, as best shown in FIG. 3, the upper tang 68 projects upwardly from the body 46 and includes an upper end portion 70 terminating in an outer corner 72 located rearwardly of a line (designated as 71 in FIG. 3) drawn in the plane of the body 46 from the center of the trailing aperture 62 and perpendicular to a line 73 (designated as 73 in FIG. 4) joining the centers of the apertures 60 and 62. Each center link 44 also includes a generally upwardly inclined upper margin 74 extending rearwardly from the leading edge 40 to the upper end portion 70 and a rear margin 76. The upper end portion 70 preferably includes a flat, horizontal upper edge 78 extending between the outer corner 72 and the upper margin 74. For purposes explained below, the rear margin 76 preferably includes a rear edge portion 80 which extends from the outer corner 72 toward the trailing portion 52 at an included angle of less than 90°.

Figure 2:
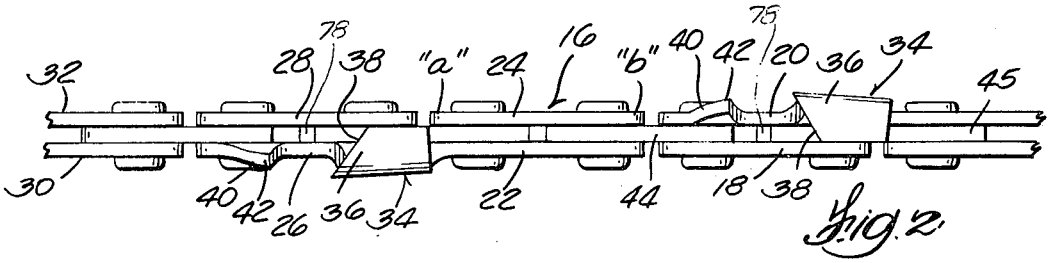
FIG. 2 is a fragmentary top view of the saw chain shown in FIG. 1.

When connected in the chain 16 as shown in FIG. 1 and the chain 16 is traveling along the elongated, flat parts of the cutter bar 10, the upper tang 68 extends toward the succeeding cutting link 34 in laterally adjacent relation with the depth gauge 40 and the outer corner 72 of the tang 68 is located rearwardly of a transverse plane (designated as 82 in FIG. 1) extending vertically from the common axis 84 of the pivotal connection between the trailing portion 52 of the center link 44 and the leading portion *a* of the cutting link 34. Also, the upper edge 78 of the upper tang 68 is generally co-planar with and located in close proximity to the uppermost edge 42 of the depth gauge 40 of the succeeding cutting link 34. Although less desirable because of the necessity of providing left and righthand center links 44, the upper tang 68 can be offset to either side the medium plane of the body 46 instead of being centrally located as shown in FIG. 2.

In operation, as the saw chain 16 travels around the nose 12 of the cutter bar 10 in the direction of the arrow 86 and the chain articulates, the center link 44 pivots relative to the succeeding cutting link 34 about the common pivot axis 84. The arcuate movement of the center link 44 about the axis 84 (illustrated by the dashed lines in FIG. 3 and indicated by angle 88) causes the outer corner 72 of the upper tang 68 to be moved from a first elevational position (designated by dashed line 90 in FIG. 3), existing during travel along the elongated, flat parts of the cutter bar 10, to a second elevational position (designated by dashed line 92 in FIG. 3) spaced at a greater distance from the periphery of the cutter bar 10.

During boring operations when a cut is being made with the nose 12 of the cutter bar 10 as illustrated in FIG. 1, the outer corner 72 of the upper tang 68 overrides the depth gauge 40, i.e., projects beyond the uppermose edge 42 of the depth gauge 40, and rides in the bottom of the saw kerf 94 to reduce the exposure of the cutting edge 38 and thereby limit the cut made by the cutting tooth 36 to a depth which materially reduces serious kickback problems. The inclined upper margin 74 of the center link 44 prevents small branches from becoming hooked or snagged on the leading edge of the succeeding depth gauge 40.

Figure 4:
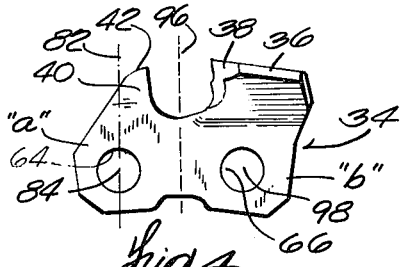
FIG. 4 is a side elevation view of a cutting tooth incorporated in the saw chain shown in FIGS. 1 and 2.

To facilitate this overriding action by the center link 44, the depth gauge 40 and the cutting tooth 36 for each cutting link 34 preferably are shifted rearwardly from the locations for conventionally constructed saw chains. That is, as best shown in FIG. 4, the uppermost edge 42 of the depth gauge 40 is located rearwardly of the plane 82 extending from the leading pivot axis 84 and the cutting tooth 36 is located rearwardly of the center of the cutting link 34, i.e., rearwardly of a transversely extending, vertical plane (designated as 96 in FIG. 3) located at the midpoint between the center 84 of the leading aperture 64 and the center 98 of the trailing aperture 66.

Since the center link 44 is located within the chain and the upper edge 78 of the upper tang 68 does not extend above the uppermost edge 42 of the depth gauge 42 during normal cutting operations, interference with chip flow is minimized in comparison to saw chain constructions employing safety links which normally extend above the depth gauge.

The cutting teeth of conventionally constructed saw chains tend to rotate about the trailing pivot axis during cutting, causing the depth gauge to dig into the kerf and produce an unstable operation. This effect becomes more pronounced as the cutting edge of the cutting tooth recedes behind the center line of the cutting link due to sharpening. The center links 44 provided by the invention tend to counteract this effect. As the depth gauge 40 tries to dig into the saw kerf 94, the center link 44 rotates in the opposite direction about the common pivot axis 84 and the resulting prying provided by the upper tang 68 engaging the bottom of the kerf 94 tends to pull the depth gauge out of the kerf. Thus, a compensating effect tending to stabilize the operation of the chain is provided.

When the cutting teeth are sharpened, it is usual practice to remove material from the uppermost edge of the depth gauge 40 in order to maintain a predetermined joint clearance. As mentioned above, the upper edge 78 of the upper tang 68 is generally co-planar with and located in close proximity to the uppermost edge 42 of the depth gauge 40. This means that a corresponding amount of material is removed from the upper tang 68 during sharpening of the depth gauge 40. Thus, the relative heights of the depth gauge 40 and the upper tang 68 are maintained constant, thereby assuring that the degree of anti-kick protected provided by the center link 44 remains constant over the full life of the chain.

As the saw chain 16 is sharpened and the horizontal distance between the cutting edge 38 of the cutting tooth 36 and the upper tang 68 increases, the effective joint clearance between the upper tang 68 and the cutting edge 38 during boring or nose cutting (i.e., the nose joint clearance) normally decreases, causing a reduction in the depth of cut made by the cutting tooth 36. The rear edge portion 80 of the upper tang 68 is arranged to extend from the outer corner 72 at an included angle of less than 90°, in accordance with a preferred embodiment of the invention, with the objective that the articulation height of the outer corner 72 (i.e., the vertical distance between lines 90 and 92 in FIG. 3) is progressively reduced consequent to sharpening so as to maintain the nose joint clearance substantially constant over the life of the saw chain.

Various of the features of the invention are set forth in the following claims.

What is claimed is:

1. A saw chain comprising a first center link having leading and trailing portions, a first pair of opposed side links each having a leading portion pivotally connected to the trailing portion of said first center link, a second pair of opposed side links each having a leading portion and trailing portion with means defining a trailing pivot axis, only one of said second pair of side links comprising a cutting link including a cutting tooth projecting from the trailing portion thereof and a depth gauge projecting from the leading portion thereof, and a second center link interposed said first and second pairs of side links and having a main body including a leading portion pivotally connected to the trailing portions of said first pair of side links and a trailing portion pivotally connected to the leading portions of said second pair of side links, said second center link including an upper tang projecting upwardly from said body in laterally adjacent relation with said depth gauge and extending in the direction toward said cutting tooth beyond a plane extending from the leading pivot axis of said second pair of side links and perpendicularly to a line connecting the leading and trailing pivot axes of said cutting link.

2. A saw chain according to claim 1 wherein said cutting tooth includes a leading cutting edge, said depth gauge includes an uppermost edge spaced below said cutting edge, and said tang includes an upper end portion terminating in an outer corner which is located beyond a plane extending from the leading pivot axis of said second pair of side links and perpendicularly to a line connecting the leading and trailing pivot axes of said cutting link, and a rear margin extending between said outer corner and the trailing portion of said second center link, said rear margin including a rear edge portion extending from said outer corner toward the trailing portion of said second center link at an included angle of less than 90°.

3. A saw chain according to claim 2 wherein the leading portion of said second center link includes a leading edge, said tang includes an upwardly and rearwardly inclined upper margin extending between the leading edge of said second center link and said upper end portion, and said upper end portion includes a flat upper edge connecting said outer corner and said upper margin and extending parallel to a line connecting the leading and trailing pivot axes of said second center link, said flat upper edge being substantially co-planar with the uppermost edge of said depth gauge.

4. A saw chain according to claim 1 wherein said cutting tooth includes a leading cutting edge located entirely rearwardly of a vertical plane extending parallel to and located at the midpoint between the leading and trailing pivot axes of said cutting link, and the uppermost edge of said depth gauge is located rearwardly of a plane extending from the leading pivot axis of said cutting link and perpendicularly to a line drawn between the leading and trailing pivot axes of said cutting link.

5. A chain saw comprising a cutter bar having a rounded nose portion and elongated, flat portions, a saw chain mounted for travel along the periphery of said cutter bar, said saw chain including a first center link having leading and trailing portions, a first pair of opposed side links each having a leading portion pivotally connected to the trailing portion of said first center link, a second pair of opposed side links each having a leading portion and a trailing portion with means defining a trailing pivot axis, only one of said second pair of side links comprising a cutting link including a cutting tooth projecting from the trailing portion thereof and a depth gauge projecting from the leading portion thereof and having an uppermost edge, and a second center link interposed said first and second pairs of side links and having a main body including a leading portion pivotally connected to the trailing portions of said first pair of side links and a trailing portion pivotally connected to the leading portions of said second pair of side links, said second center link including an upper tang projecting upwardly from said body in laterally adjacent relation with said depth gauge and having an upper end portion extending toward said cutting tooth beyond a plane extending from the leading pivot axis of said second pair of side links and perpendicularly to a line connecting the leading and trailing pivot axes of said cutting link, the upper end portion of said upper tang having an upper edge which is substantially co-planar with the uppermost edge of said depth gauge when said second center link and said second pair of side links are traveling along the flat portions of said cutter bar, and terminating in an outer corner which projects, outwardly beyond the uppermost edge of said depth gauge, when said second center link and said second pair of side links are traveling around the nose portion of said cutter bar.

6. A chain saw according to claim 5 wherein the leading portion of said second center link includes a leading edge and said tang includes an upwardly and rearwardly inclined upper margin extending between the leading edge of said second center link and said upper end portion.

7. A chain saw according to claim 6 wherein said cutting tooth includes a leading cutting edge located entirely rearwardly of a vertical plane extending parallel to and located at the midpoint between the leading and trailing pivot axes of said cutting link, and the uppermost edge of said depth gauge is located rearwardly of a plane extending from the leading pivot axis of said cutting link and perpendicularly to a line drawn between the leading and trailing pivot axes of said cutting link.

8. A chain saw according to claim 5 wherein said upper tang including a rear margin extending between said outer corner and said trailing portion, said rear margin including a rear edge portion extending from said outer corner toward said trailing portion at an included angle of less than 90°.

9. A chain saw according to claim 5 wherein said upper tang includes an upwardly and rearwardly inclined upper margin extending between said leading edge and said upper end portion and said upper end portion includes a flat upper edge connecting said outer corner and said upper margin and extending parallel to a line connecting the centers of said leading and trailing aperatures.

10. A saw chain according to claim 1 wherein said tang includes a flat upper edge substantially co-planar with the uppermost edge of said depth gauge.

11. A saw chain comprising a first center link having leading and trailing portions, a first pair of opposed side links each having a leading portion pivotally connected to the trailing portion of said first center link, a second pair of opposed side links each having a leading portion and a trailing portion with means defining a trailing pivot axis, one of said second pair of side links comprising a cutting link including a cutting tooth projecting from the trailing portion thereof, and a second center link interposed said first and second pairs of side links and having a main body including a leading portion pivotally connected to the trailing portions of said first pair of side links and a trailing portion pivotally connected to the leading portions of said second pair of side links, said second center link including an upper tang projecting upwardly from said body and extending in the direction toward said cutting tooth beyond a plane extending, when said chain extends in a straight line, from the leading pivot axis of said second pair of side links and perpendicularly to a line connecting the leading and trailing pivot axes of said cutting link.

12. A saw chain comprising a first center link having leading and trailing portions, a first pair of opposed side links each having a leading portion pivotally connected to the trailing portion of said first center link, a second pair of opposed side links each having a leading portion and trailing portion with means defining a trailing pivot axis, one of said second pair of side links comprising a cutting link including a cutting tooth projecting from the trailing portion thereof, one of said second pair of side links including a depth gauge projecting from the leading portion thereof, and a second center link interposed said first and second pairs of side links and having a main body including a leading portion pivotally connected to the trailing portions of said first pair of side links and a trailing portion pivotally connected to the leading portions of said second pair of side links, said second center link including an upper tang projecting upwardly from said body in laterally adjacent relation with said depth gauge and extending in the direction toward said cutting tooth beyond a plane extending, when said chain extends in a straight line, from the leading pivot axis of said second pair of side links and perpendicularly to a line connecting the leading and trailing pivot axes of said cutting link.

* * * * *